United States Patent [19]

LaVene

[11] 4,114,417

[45] Sep. 19, 1978

[54] METHOD AND APPARATUS FOR MAKING METAL PARTS

[75] Inventor: Leon F. LaVene, Durand, Mich.

[73] Assignee: Schmelzer Corporation, Durand, Mich.

[21] Appl. No.: 810,306

[22] Filed: Jun. 27, 1977

[51] Int. Cl.[2] ..... B21D 31/00

[52] U.S. Cl. ..... 72/379; 72/400; 72/404

[58] Field of Search ..... 72/348, 377, 379, 400, 72/405, 404, 452, 334, 335

[56] References Cited

U.S. PATENT DOCUMENTS

| | | | |
|---|---|---|---|
| 1,837,720 | 12/1931 | Luce | 72/348 |
| 3,182,483 | 5/1965 | Karmazin | 72/405 |
| 3,194,200 | 7/1965 | Brogren | 72/379 |
| 3,289,523 | 12/1966 | Kramer | 85/36 |
| 3,479,979 | 11/1969 | Dunn | 72/377 |

*Primary Examiner*—C.W. Lanham
*Assistant Examiner*—Gene P. Crosby
*Attorney, Agent, or Firm*—Fisher, Gerhardt & Groh

[57] ABSTRACT

A method and apparatus for making a housing member with a projecting bracket receiving adaptor from a sheet of flat material in which the material is formed in progressive dies by displacing material in the direction of die movement and also transversely thereof by a die arrangement movable into engagement with a portion of the material displaced in the direction of die movement to confine that portion while permitting displacement of the unconfined portion transversely.

13 Claims, 10 Drawing Figures

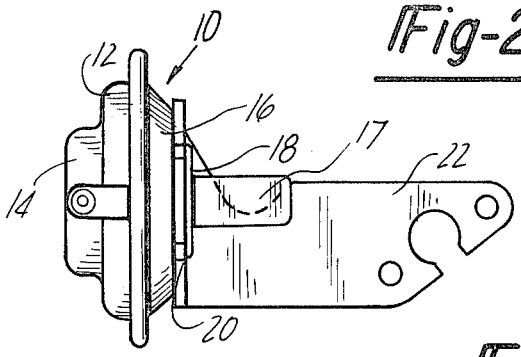
Fig-1
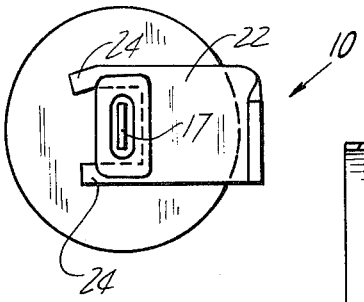
Fig-2
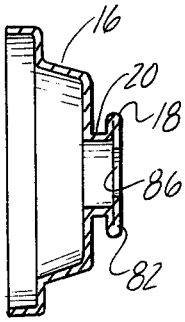
Fig-3
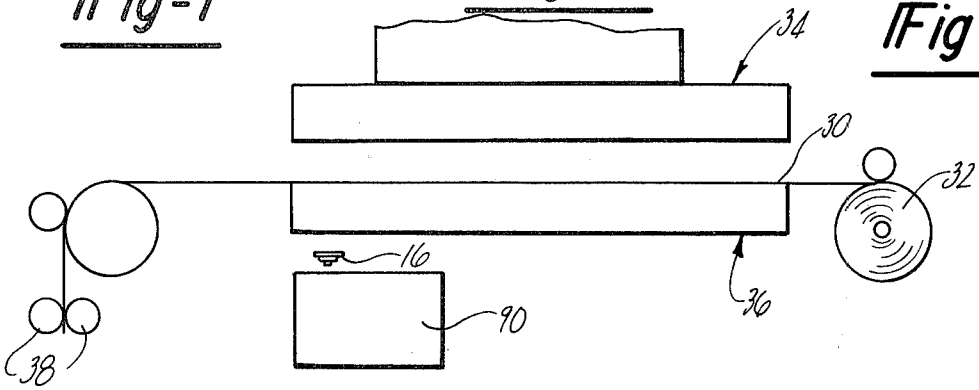
Fig-4
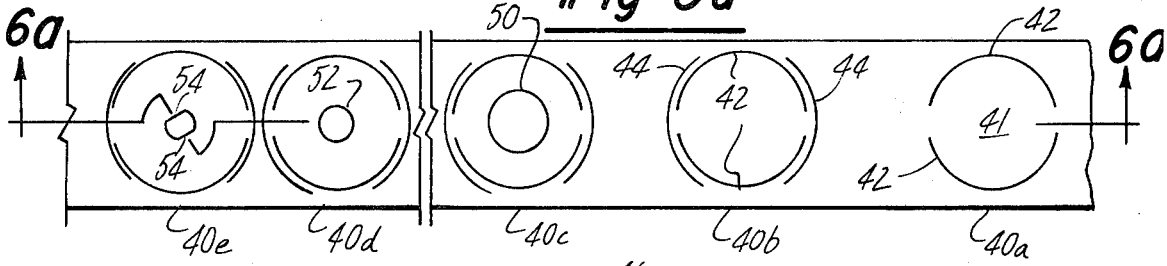
Fig-5a
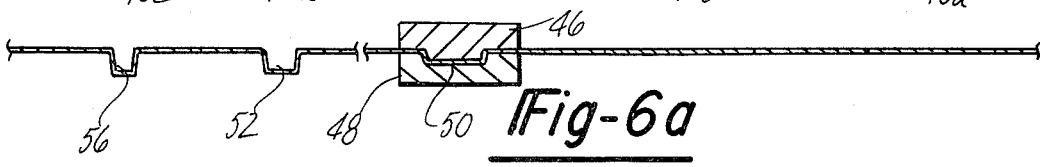
Fig-6a
Fig-5b
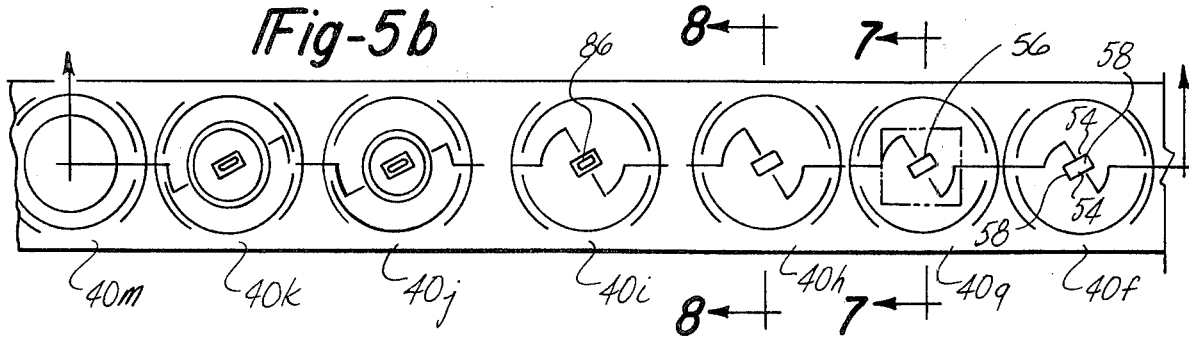
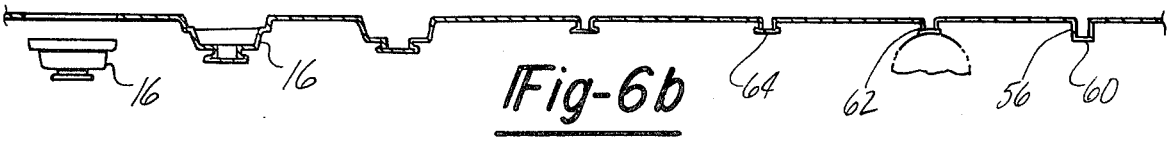
Fig-6b Fig-7
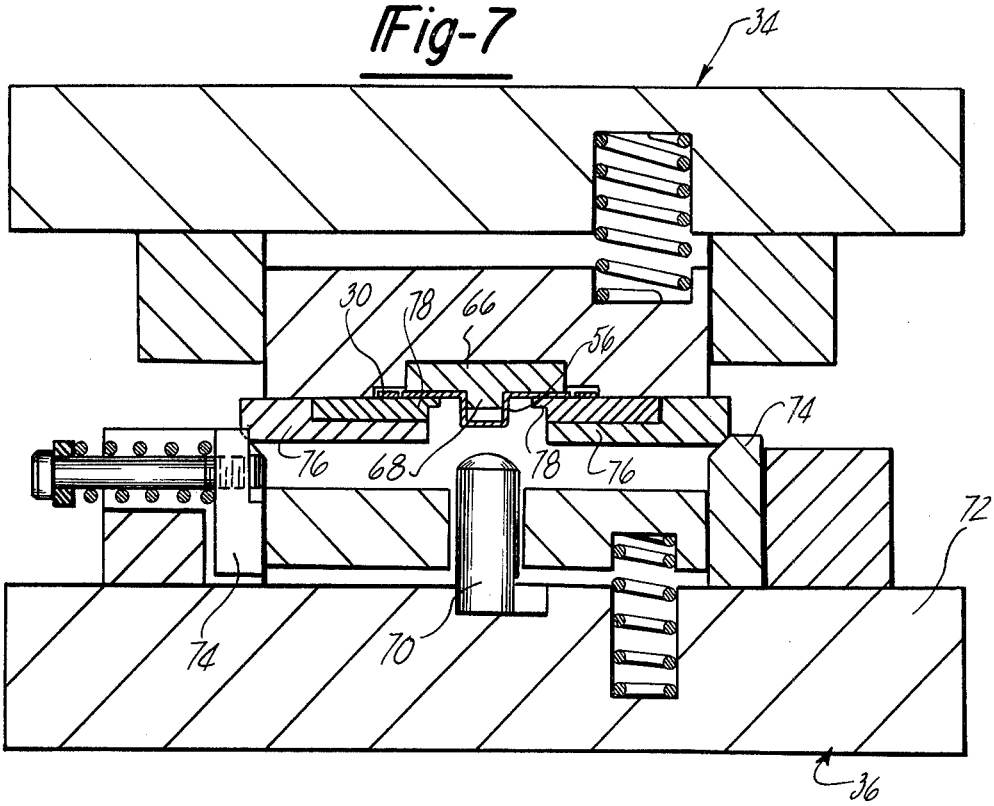
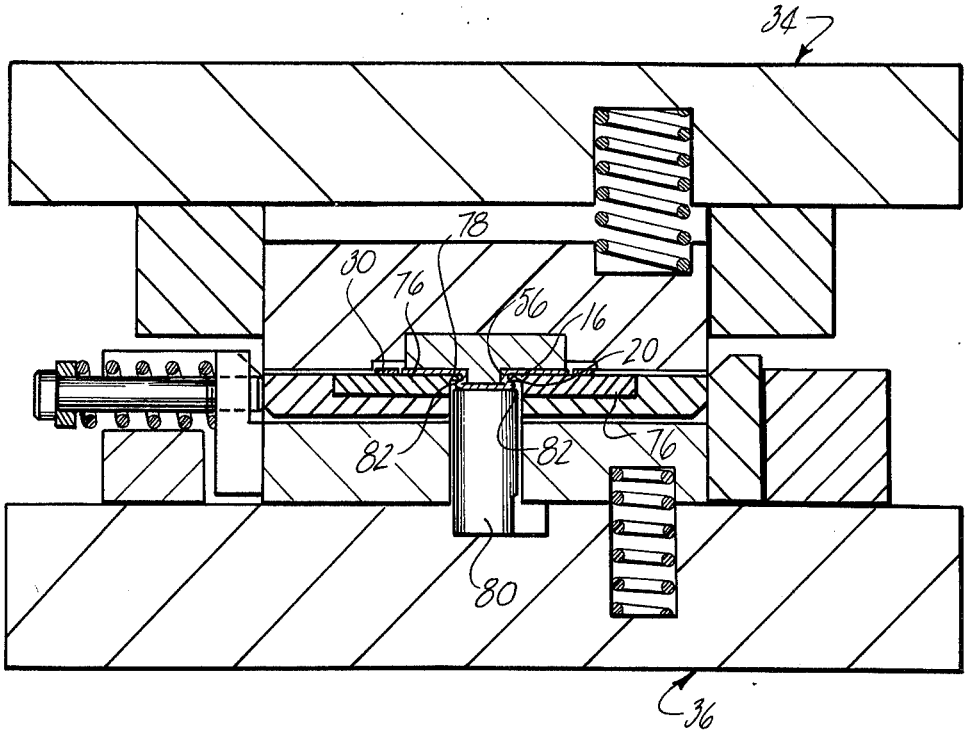
Fig-8

METHOD AND APPARATUS FOR MAKING METAL PARTS

This invention relates to a method and apparatus for forming metal parts in progressive dies or stops and more particularly it relates to the method and apparatus for forming a mounting structure on a wall of a hollow housing in which the mounting structure has a peripheral groove for receiving a mounting bracket.

In the manufacture of small vacuum servo motors, housing parts are usually stamped from flat sheet metal in progressive dies and mounting brackets are affixed to the servo motors by welding or the like. Such attaching procedures often cause distortion of the part which requires additional manufacturing operation to resize the part after welding or subjects the housing to leakage.

A common method of forming flat sheet metal into stamped parts is to use progressive dies to work on a continuous strip of material and the forces to form the material are applied from opposite surfaces of the metal strip in such a manner that the dies may be moved toward and away from each other at a relatively high speed without interference. However, most of such methods and equipment do not lend themselves to the manufacture of parts in which the material must be displaced not only axially in the direction of die movement but also transversely to that direction.

It is an object of the invention to provide a method of forming sheet metal parts in which material is displaced not only to form a cup shaped part but also to form a groove in an outer perimeter of said cup.

It also is an object of the invention to form a housing with a mounting adaptor suitable to receive a bracket in which the adaptor is formed integrally with the remainder of the housing.

Another object of the invention is to provide a method of manufacturing a housing member with an adaptor to receive a mounting bracket wherein the adaptor is formed with a peripheral groove to slidably receiving the bracket.

These and other objects will be apparent from the following description and from the drawings in which:

FIG. 1 is a side elevation of a servo motor incorporating a housing part made in accordance with the present invention;

FIG. 2 is an end view of the servo motor in FIG. 1;

FIG. 3 is a cross sectional view of one part of the servo motor in FIG. 1;

FIG. 4 is a diagrammatic view of a press incorporating progressive dies for performing the method of the present invention;

FIGS. 5*a* and 5*b* are top plan view of a strip of material as it would appear at any one time after operation in the press of FIG. 4;

FIGS. 6*a* and 6*b* are cross sectional views taken on lines 6*a*—6*a* and 6*b*—6*b* in FIGS. 5*a* and 5*b;*

FIG. 7 is a cross sectional view of the progressive dies taken on line 7—7 in FIG. 5b; and FIG. 8 is a view similar to FIG. 7 but showing the dies in another position of operation at the station indicated at line 8—8 in FIG. 5*b*.

Referring to the drawings and particularly to FIG. 1 through 3, the part to be formed by the method of the present invention is embodied in a servo motor 10 which has a housing 12 formed by a pair of cover member 14 and 16 and an output member 17 which reciprocates in an opening in the cover 16. The cover member 16 is formed with a bracket adaptor 18 which is generally rectangular and is formed with a peripheral groove 20. The bracket adaptor is formed integrally with the remainder of the cover 16 and the groove 20 receives the forked end of a bracket 22 having tines 24. The tines 24 are disposed in oppositely facing portions of the grooves 20 to hold the housing against rotation relative to the bracket and the outer terminal ends may be distorted towards each other to prevent removal of the housing 12 from the bracket 22. The bracket 22 itself is adapted to be connected in any conventional manner to the devices with which the servo motor 10 is to be used.

In general the integral housing cover 16 and bracket adaptor 18 is formed in a reciprocating press incorporating progressive dies. In such an operation a strip of flat metallic material 30 is fed from a supply roll 32 to move between an upper die set 34 and lower die set 36. The strip 30 can be moved from station to station by pull rolls 38. The lower die set 36 remains stationary and the upper die set 34 reciprocates vertically. Each die set 34 and 36 has a plurality of die stations each giving a different form to the strip 30. After each reciprocation of the upper die set 34, the strip 30 is advanced to the let as view in the drawings the distance between adjacent stations. In actual practice the part 16 is formed at about twenty different stations although more stations may be used, some of which can remain idle.

Referring now to FIGS. 5*a* and 6*a* opposed dies in the upper die set 34 and lower die set 36 coact at a first station indicated at 40*a* to cut and define a circular work piece portion 41 having diametrically opposed semi-circular slits 42 which permit the circular work piece portion 41 to remain attached to the remainder of strip 30. At the next station indicated at 40*b*, diametrically opposed arcuate slits 44 which are slightly larger in diameter than the slits 42 are cut forwardly and rearwardly of the direction of motion of the strip 30. The slits 42 and 44 permit movement of the material in the circular work piece portion 41 during the various forming operations without restriction to metal flow by the surrounding metal of the strip and at the same time permits the work piece portion to be advanced as a unit with all of the work piece portions.

After the circular work piece portion 41 is formed by the slits 42 and 44, a conventional male die section indicated diagrammatically at 46 and a matching female die section 48 are used to draw or to form a shallow, round cup 50 at station 40*c*. In the next three or more stations, which are not shown, dies similar to 46 and 48 are used to reshape the cup 50 so that it becomes progressively deeper in axial length and smaller in circumference until a cup 52 is formed at station 40*d* indicated in FIGS. 5*a* and 6*a*.

At the next station 40*e*, the cup 42 from station 40*d* is formed with a pair of diametrically opposied parallel walls 54 and in the next several stations, which are not illustrated, the cup is formed to be progressively more rectangular and axially deeper until a cup 56 is formed at station 40*f* in FIGS. 5*b* and 6*b* which in addition to parallel walls 54 has opposed parallel walls 58 forming a rectangular cross-section and a flat bottom 60.

At the next station indicated at 40*g* in FIGS. 5*b* and 6*b*, the original bottom wall 60 is deformed upwardly so that it has a concanvity and a flange 62 around the outer perimeter of the rectangular cup 56. At the next station indicated at 40*h*, the bottom wall is flatened to form a new flange bottom wall 64.

The operation by which the bottom 60 and 64 are formed is accomplished by an apparatus seen in FIGS. 7 and 8. The upper die set 34 includes a conventional male die insert 66 which as seen in FIG. 7 has a forming portion 68 occupying only the upper portion of the interior of rectangular cup 56. The lower die set 36 includes a punch member 70 which is held stationary relative to the base plate member 72 of the lower die set 36. The lower die set 36 also includes a pair of opposed stationary cam members 74 adapted to engage complementary cam surfaces on transversely movable holding member 76 which are mounted to move parallel to the base plate 72 and in opposite directions toward each other upon downward movement of the upper die set 34 from the position seen in FIG. 7 toward the position seen in FIG. 8. Upon downward movement of the upper die set 34 from the position in FIG. 7 to the position in FIG. 8 the die 66 enters the upper portion of the rectangular cup 56 and moves the strip 30 downwardly. Such movement moves the holding members 76 downwardly relative to the fixed cam members 74 and simultaneously in a horizontal direction toward each other transversely of the strip 30 and into engagement with opposed walls of the cup shaped portion 56. Each holding member engages one long wall 54 and the adjoined short wall 58. The holding members 76 having gripping portions 78 which engage the exterior walls of the cup shaped member 56 opposite to the die portion 68 at the interior of the walls leaving the remainder or lower portion of the walls unsupported. Continued downward movement of the upper die set 34 and strip 30 brings the bottom of the rectangular cup 56 into engagement with the punch 70. Thereafter the bottom unsupported and unconfined portion of the cup 56 is formed by the end of the punch 70 so that material is displaced radially outwardly of the walls 54 and 58 to form the flange portion 62 as seen at station 40*g* in FIG. 6*b*.

The apparatus as seen in FIG. 7 at station 40*g* is essentially the same at station 40*h* and FIG. 8 except that a punch 80 is substituted for punch 70. The punch 70 has a hemispherical head whereas the punch 80 at station 40*h* and in FIG. 8 has a flat end surface 82.

The operation of the apparatus at station 40*h* and as seen in FIG. 8 is essentially the same as the apparatus in FIG. 7. Upon engagement of the punch member 80 with the concave bottom of the cup shaped member 56 the bottom wall is flattened and the lower portion of the side walls 54 and 58 are collapsed and folded on to the bottom portion to form flanges 82 which extends around the entire periphery of the cup member 56. The flange 82 together with the remainder of the work piece forms the groove 20 which receives the bracket member 22.

As seen in FIG. 8, the holding members 76 are so formed that after they come into engagement with the outer surface of the rectangular cup shaped member 56, movement of the upper die set 34 relative to the lower die set 36 is limited by the thickness of the holding member 76. As the press comes to the bottom of the stroke the folded over portions of the walls 54 and 58 in engagement with the bottom 60 are pressed against one side of the gripping portion 78 and the strip 30 is pressed against the opposite side so that groove 20 is accurately shaped by gripping portions 78 and no further sizing operations are required.

After the metal strip 30 is advanced from station 40*h* as seen in FIGS. 5*b* and 6*b*, the bottom 60 of the rectangular cup 56 is pierced at station 40*i* to form an opening 86 which receives the output member of the servo motor 10. At station 40*j* and subsequent stations the work piece 41 is progressively formed so that the portion surrounding the cup 56 are formed into a dish shaped cover which is generally coaxial with the cup 56. Thereafter, several stations may be employed to progressively form the cover member from the configuration seen at station 40*j* in FIG. 5*b* and 6*b* to the configuration illustrated at station 40*k*. At station 40*m* the circular work piece portion 41 is in the form of an integral housing cover 16 and bracket adaptor 18 which may be severed from the strip 30 in a conventional manner. Thereafter, cover 16 may drop into a receptacle 90 to be accumulated for future assembly with the cover member 14.

The method and apparatus for forming a cover member for a housing with a bracket adaptor in which a bracket adaptor and housing cover are formed integrally with each other has been provided in which progressive dies can be used to form and displace metal, not only normal to the surfaces of the stock but also transversely to the stock. The resultant stamped metal product is one in which a rectangular bracket adaptor is formed on the exterior wall of a housing and the bracket adaptor itself is of rectilinear configuration with a peripheral annular groove which is formed without interference of movement between the reciprocating die members normally used in progressive die equipment.

I claim:

1. The method of making a bracket adaptor on the wall of a housing in which the adaptor is a generally rectangular cup protruding from a wall and is characterized by a peripheral groove on the exterior of said cup, the steps of forming a cup-shaped portion in the workpiece by applying a force in opposite direction on opposed surfaces of said workpieces with mating dies, said cup having a closed end with opposed pairs of parallel walls defining a rectilinear cross-section, holding walls of said cup adjacent to the surface of said workpiece against displacement in a direction parallel to the surface of said workpiece, and applying a force on the end wall of said cup to form oppositely extending flanges on opposed walls to form a continuous groove around the periphery of said cup adapted to receive a bracket therein, said holding of said walls being accomplished by holding members movable towards each other in response to movement of said dies towards each other.

2. The method of claim 1 in which the walls of said cup shaped portion are held against displacement by a die seated in the open end of said cup and occupying a portion of the cup adjacent to the surface of said strip, the exterior of said cup being held by holding members engaging the wall opposite to said die and in which the force applied on the end wall of said cup is applied on an unconfined part of said cup.

3. The method of claim 1 in which a plurality of mating dies are used to form said cup shaped portion in progressive steps by moving said dies simultaneously towards each other by relative reciprocation vertically and moving said holding members horizontally into engagement with said cup upon movement of said dies towards each other.

4. The method of claim 1 in which the force applied on the end wall of said cup is applied by a member to form a concave surface at one station and a force is applied by another member at another station to form said concave surface into a flat surface.

5. The method of claim 1 in which a strip of material is cut to define a circular work piece portion retained in attached condition to said strip of material and in which said cup is formed in said circular work piece portion.

6. The method of claim 5 in which circular work piece portions are formed at the first station and a cup shaped portion is formed at a second station during which time said circular work piece portions are being formed at said first station.

7. The method of making a bracket adaptor on the wall of a housing in which the adaptor is a generally rectangular cup protruding from a wall and is characterized by a peripheral groove on the exterior of said cup, the steps of forming a cup-shaped portion in a workpiece by applying a force in opposite direction on opposed surfaces of said workpiece, said cup having a closed end with opposed pairs of parallel walls defining a rectilinear cross-section, holding walls of said cup adjacent to the surface of said workpiece against displacement in a direction parallel to the surface of said workpiece, applying a force on the end wall of said cup to form oppositely extending flanges on opposed walls to form a continuous groove around the periphery of said cup adapted to receive a bracket therein and forming a dish-shaped cover with said cup disposed on the axis of said cover.

8. The method of claim 6 and further comprising the step of severing said circular work piece portion and cover from said strip and from the adjacent circular work piece portion.

9. The method of forming a housing wall with an integral bracket adaptor which is generally cup shaped and rectangular in cross section with a peripheral groove on the exterior of the cup comprising the steps of: cutting an elongated strip of material to define a circular work piece at a first station, said work piece remaining partially attached to said strip of material, forming a cup in said work piece at a second station, said cup being disposed axially of said circular work piece and having a rectangular cross section, holding the inner and outer wall portions of said cup around its entire periphery and adjacent to said strip of material while leaving the bottom wall and adjacent portions of the side walls unconfined, applying an axial force on the external bottom wall of the cup to fold the material in the lower portion of said wall against the bottom wall of said cup to form a flange extending axially outwardly from the side walls of said cup to provide an annular groove adapted to receive a bracket.

10. A progressive die apparatus for the formation of a sheet metal part comprising; a pair of opposed relatively vertically movable die sets adapted to receive a strip of material therebetween, said strip of material being advanced progressively upon reciprocation of said die set, said upper and lower die sets including a plurality of complementary male and female die portions coacting with each other to progressively form a cup-shaped portion in said strip of material, one station of said apparatus including a pair of laterally movable holding mechanisms, said holding mechanisms being adapted to engage and confine an exterior surface of said cup-shaped portion adjacent to said strip of material and leave the remainder of said cup-shaped portion unsupported, means associated with said lower die set and being operative to engage the bottom of said cup-shaped portion to displace the unconfined portion of said cup-shaped portion radially outwardly from the axis of said cup-shaped portion to form a groove at the exterior of said cup-shaped portion, said laterally movable mechanisms being movable in response to movement of said upper die set relative to said lower die set.

11. The combination of claim 10 wherein said holding mechanism has portions of a predetermined thickness movable into said groove to a position limiting movement of said die sets toward each other to accurately form the width of said groove.

12. The combination of claim 10 wherein said holding mechanisms are movable with one die set towards the other of said die sets after said holding mechanisms move into engagement and confine the exterior surface of said cup-shaped portion.

13. The combination of claim 10 and further comprising means moving said holding mechanisms including cam members associated with one of said die sets, said holding mechanisms being movable into engagement with said cam members by the other of said die sets.

* * * * *

UNITED STATES PATENT AND TRADEMARK OFFICE

CERTIFICATE OF CORRECTION

PATENT NO. : 4,114,417

DATED : September 19, 1978

INVENTOR(S) : Leon F. LaVene

It is certified that error appears in the above-identified patent and that said Letters Patent are hereby corrected as shown below:

Column 1, line 2, "stops" should read --steps--

Column 2, line 8, "grooves" should read --groove--

Column 2, line 25, "let" should read --left--

Column 2, line 56, "opposied" should read --opposed--

Column 4, line 34, "the" second occurrence should read --a--

Column 4, line 36, "workpieces" should read --workpiece--

Signed and Sealed this

*Eleventh* Day of *March 1980*

[SEAL]

*Attest:*

SIDNEY A. DIAMOND

*Attesting Officer*

*Commissioner of Patents and Trademarks*